United States Patent [19]

Davis

[11] Patent Number: 4,857,107

[45] Date of Patent: Aug. 15, 1989

[54] GOLD INQUARTATION PROCESS

[75] Inventor: Edward E. Davis, Castle Cove, Australia

[73] Assignee: Fine Metals Export Corporation Limited, Marrickville, Australia

[21] Appl. No.: 82,405

[22] PCT Filed: Sep. 12, 1986

[86] PCT No.: PCT/AU86/00269

§ 371 Date: May 18, 1987

§ 102(e) Date: May 18, 1987

[87] PCT Pub. No.: WO87/01732

PCT Pub. Date: Mar. 26, 1987

[30] Foreign Application Priority Data

Sep. 12, 1985 [AU] Australia ..... PH 02406

[51] Int. Cl.[4] ..... C22C 3/00; C22C 11/04

[52] U.S. Cl. ..... 75/97 A; 75/100; 75/118 R; 75/93 R

[58] Field of Search ..... 75/118 R, 97 A, 93 R, 75/100

[56] References Cited

U.S. PATENT DOCUMENTS

| | | | |
|---|---|---|---|
| 7,661 | 9/1850 | Booth | 75/100 |
| 7,670 | 9/1850 | McCulloh | 75/100 |
| 53,340 | 3/1866 | Reynolds | 75/100 |
| 176,813 | 5/1876 | Rogers | 75/118 R |
| 984,090 | 2/1911 | Jones et al. | 75/118 R |
| 1,192,945 | 8/1916 | Sherwood | 75/118 R |
| 3,920,790 | 11/1975 | Pittie et al. | 75/118 R |
| 4,002,469 | 1/1977 | Oliver et al. | 75/101 R |
| 4,261,738 | 4/1981 | Valentine et al. | 75/103 |
| 4,293,332 | 10/1981 | Wang et al. | 75/99 |

OTHER PUBLICATIONS

Perry et al., *Chemical Engineer's Handbook,* McGraw-Hill, 5th Ed., 1973, N.Y., pp. 8-57.

*Primary Examiner*—William R. Dixon, Jr.
*Assistant Examiner*—David M. Brunsman
*Attorney, Agent, or Firm*—Townsend and Townsend

[57] ABSTRACT

A method of refining a precious metal comprising the steps of inquarting the material containing the precious metal into an alloy, with a known quantity of a base metal to form an alloy of a known concentration of the precious metal, and dissolving the base metal in acid to leave the refined precious metal as a solid. Preferably the method is used to refine gold, and the acid used is nitric acid, followed by a secondary acid treatment of hydrochloric acid.

4 Claims, 2 Drawing Sheets

GOLD INQUARTATION PROCESS

Figure 1:
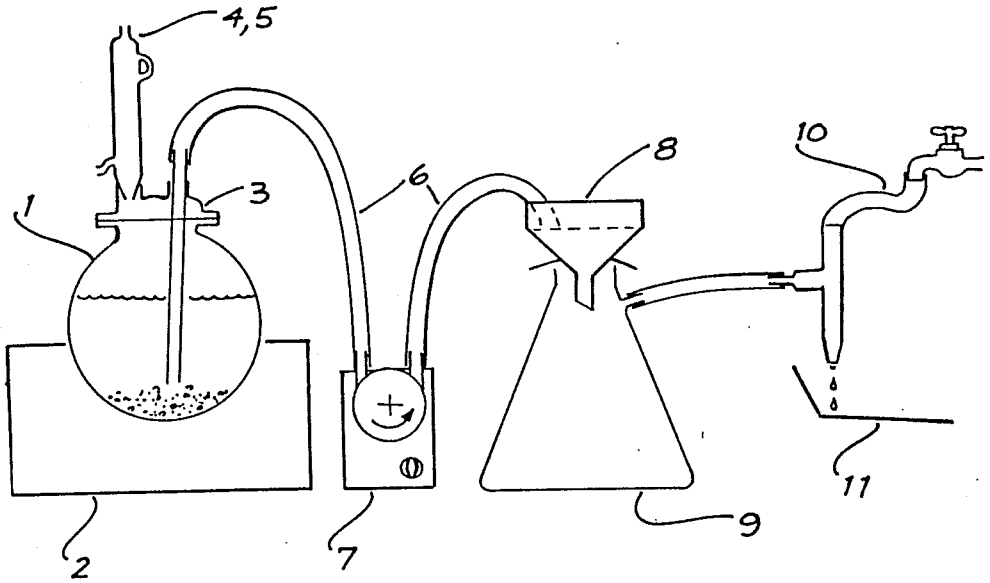

The present invention relates to methods for the separation of precious metals from other metals and in particularly methods of refining gold.

Conventional refining methods for refining gold involves the use of aqua regia for parting whereby the gold is dissolved by the aqua regia and the dissolved gold is then recovered from solution by way of chemical precipitation, or electrolysis.

Both of these systems are expensive and are usually unsuitable for the refining of smaller quantities, due to the number of steps required to collect the gold.

Conventional refining methods, such as aqua regia parting and the like only refine gold to a level in the vicinity of 95%, and usually below this. However, Bullion is classified as gold having a purity in excess of 96% and fine Bullion being in excess of 99%. Thus to further refine gold which has been first refined by aqua regia parting, requires a further step of electrolytic parting or other process. This usually means the sending away of the gold to be refined, which increases costs, involves security risks, and takes one to two weeks before the final product results.

Other systems for the refining of gold require the shipment of the gold to places other than the miner's premises. This outside refining can take weeks to perform with various hazards and costs in the shipment of the product to the refinement site.

Further, the refinement area or site also knows the exact amount of gold being refined.

It is an object of the present invention to provide a single step method of refining precious metals which will substantially overcome or ameliorate the above-mentioned disadvantages, by producing bullion grade precious metals in said single step.

According to one form of the present invention there is provided a method of refining a precious metal comprising the steps of:

(a) assaying the material, containing the precious metal to be extracted, to determine the concentration of the precious metal in the material;

(b) inquarting the material containing the precious metal to be extracted into an alloy with a known quantity of a base metal, such as copper, to form an alloy of a known concentration of the precious metal to be extracted;

(c) dissolving the base metal in acid to leave the refined precious metal; and (d) filtering the precious metal from the thus formed solution.

According to another aspect of the present invention there is disclosed a method of refining a precious metal, said method being a single process including at least the following steps:

(a) granulating a precious metal bearing ore;

(b) inquarting said granulated ore with a base metal; and (c) subjecting said inquarted material to nitric acid parting.

Preferably the precious metal being refined is gold whilst the inquarting is performed so that the resultant material has a precious metal content of 15% to 40% and most preferably 25%.

Figure 2:
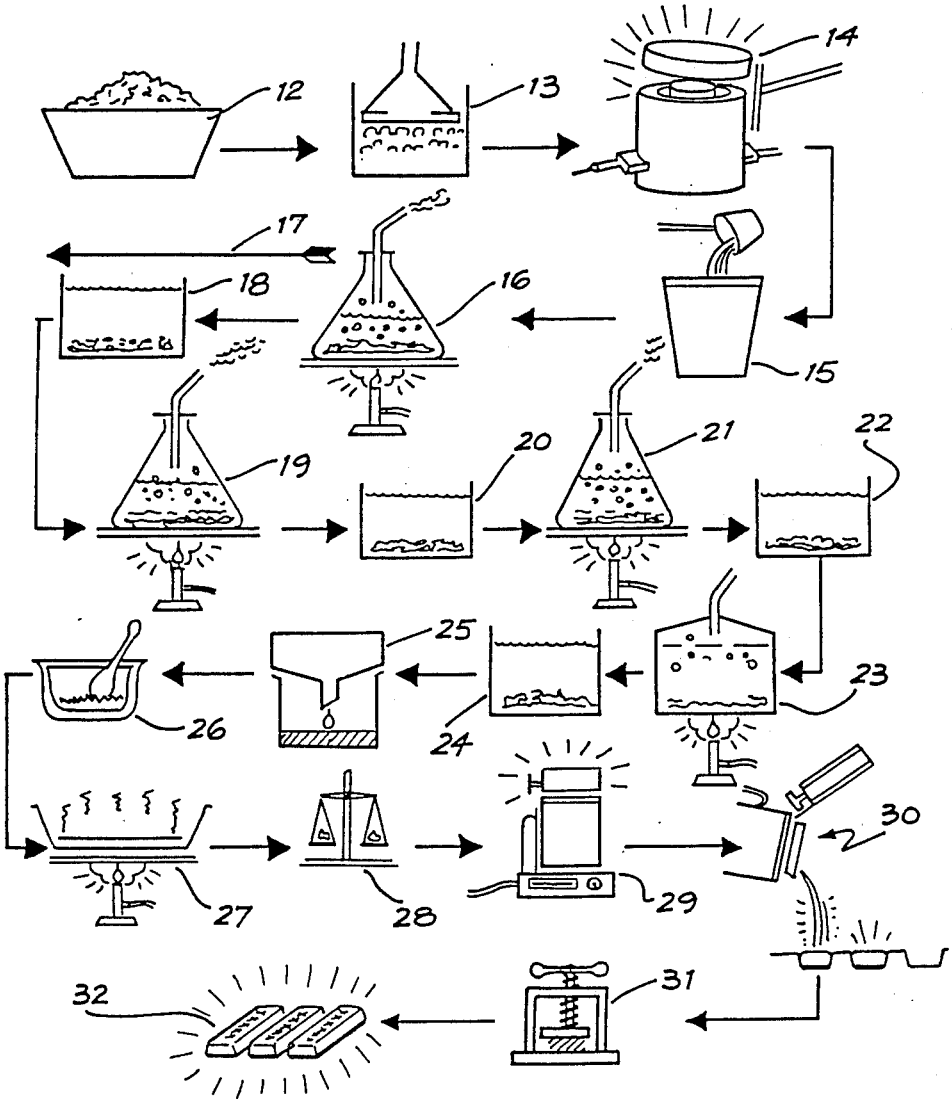

The present invention will now be described by way of example only with reference to the following examples and the figures of the drawings in which:

FIG. 1 illustrates a schematic view of the equipment set up for the disolution stage of nitric acid parting; and FIG. 2 illustrates a schematic view of the refining process.

The following are examples of several methods used to extract gold from the prepared alloy.

EXAMPLE 1

Nitric Acid Parting

The method of this example was performed on 498 g of granulated alloy with the composition:

62.3% Ag
25.6% Au
2.4% Pd
0.07% Pt
9.7% base metals 100 g of the 498 g of granulated alloy were treated with 500 ml of nitric acid, diluted to the ratio of 1:1, to obtain a fine gold residue and a parting solution containing the silver, palladium and base metals. Silver and palladium were readily recovered by precipitation on copper wire. Assays performed on the gold and silver products and barren liquor gave the following results:

GOLD RESIDUE: Greater than 99.9% Au, 270 ppm Ag, 60 ppm Pd, less than 20 ppm Pt

SILVER PRECIPITATE: 95.5% Ag, 4.0% Pd, 0.33% Cu, 1180 ppm Pt, 520 ppm Au

BARREN LIQUOR (3 l): 10 g/l Cu, 2.1 mg/l Ag, 1.5 mg/l Pd, less than 1 mg/l Pt

Note especially that the levels of silver, palladium and platinum in the gold were very low, totalling less than 0.035%.

EXAMPLE 2

Aqua Regia Parting

Aqua regia parting is a well known process and to compare performance of nitric acid parting to aqua regia parting the first mentioned alloy was treated by aqua regia parting, even though this alloy contained a much higher silver content than can normally be treated by aqua regia. A number of operating problems were encountered in this approach and made the approach unattractive. Dissolution was very slow and incomplete, due to the high silver content. Further, filtration of the acid gold solution required special filter paper and it was difficult to obtain a clear filtrate because a fine precipitate formed on cooling.

GOLD PRECIPITATE: 99.8% Au, 1150 ppm Ag, 550 ppm Pd

SILVER: 95% Ag, 4.1% Pd, 0.51% Cu, 1850 ppm Pt

Nitric acid parting is the preferred process for laboratory scale refining of gold-silver alloys. Gold recovery exceeds 99% and the gold residue obtained exceeds 995 fineness. Silver is readily recovered by cementation on copper as a silver-palladium-platinum alloy which would need further treatment to remove the platinum metals.

EXAMPLE 3

The following examples were conducted on a gold silver alloy which had been made by melting scrap gold with nearly three times its weight of silver. To avoid the inevitable lock-up of silver, parting tests were conducted on an alloy made by inquarting scrap gold with copper rather than silver. The following examples and methods were conducted on a total of 353.7 g of granulated alloy having the following composition:

67% Cu
25.2% Au
6.2% Ag
Less than 0.1% Pd
0.06% Pt
0.1-1% Fe, Zn, Sn

EXAMPLE 3

Nitric Acid Parting

The copper-gold alloy dissolved readily in 1:1 $NHO_3$. The gold was easily recovered as granular metal. Silver was precipitated as silver chloride (AgCl) by salting the liquor and was easily recovered by filtration.

Attempted reduction of AgCl to silver by granulated zinc in an acid slurry of the chloride was not successful. It was not possible to separate the silver from the undissolved zinc. Further tests needed to show whether all the silver could be recovered by seeding with a minimum of zinc, all of which goes into solution. This would overcome the separation problem. Alternatively, the AgCl could be reduced to the metal by fusion with borax, soda ash and carbon.

Platinum was recovered from the parting solution by adding $HN_4Cl$. No precipitate was obtained, even after adjusting the solution's pH. It was later found that the alloy contained only 0.06% platinum and less than 0.1% palladium, too little for this method to be successful.

Palladium was recovered from the parting solution via precipitation of $Pd(NH_3)_3Cl_2$ but of course none was obtained, since the alloy contained no palladium.

Assays of the gold and silver products and the barren liquor gave the following results:

GOLD RESIDUE: 98.9% Au, 2.7 ppm Ag
CEMENT SILVER: 95% Ag, balance Zn
BARREN LIQUOR (6.3 1): 1.8 mg/l Ag, 10.5 mg/l Pt Gold recovery was only 95%; however better than 99% can be realisticially expected when the process is conducted using equipment and conditions described hereinafter. The same applies to the fineness of the gold residue—we believe that 99.5% purity will be achievable on a regular basis. With some refinement to the method, 99.9% should be possible.

EXAMPLE 4

Aqua Regia Parting

Previous attempts at aqua regia parting were unsuccessful because silver content exceeded 8%. The gold-copper alloy contained only 5-6% Ag so it was felt worthwhile to try again. An advantage of the aqua regia process is that platinum and palladium recovery is less troublesome than in nitric acid parting.

This test showed that aqua regia parting at laboratory scale, even of low silver alloys, is a more difficult and time-consuming process than nitric acid parting. For instance, the reaction can become violent, special glass filter papers are needed, the precipitated gold is likely to be contaminated and is difficult to recover without loss, because of its fineness.

Platinum and palladium recovery were unsuccessful for the reasons given in Example 1.

Thus, gold refining performed by direct nitric acid parting of alloys formed by inquarting scrap gold with copper is a good method when the granulated parting alloy contains not more than 25% gold.

A detailed description of nitric acid parting is now described with reference to FIG. 1.

The following describes in detail the methods used for nitric acid parting of gold, silver, copper alloys. This method is particularly for use in relation to 800 g batches which contain no more than 25% gold.

All reagents should be laboratory reagent quality, equivalent to Ajax Chemical's UNILAB TM grade.

Water should be deionised or distilled, or at least known to contain less than 2 ppm chloride ion.

Primary Dissolution (This will be described with reference to the FIG. 1).

(a) A 5 liter reaction flask 1 was set up in heating mantle 2.
(b) 800 g of Au-Ag-Cu alloy was placed in the bottom of reaction flask 1.
(c) 2 liters of water was then added, and then 2 liters of concentrated nitric acid was slowly added. (Washed acid can be utilised from the previous dissolution can be substituted in whole or part.)
(d) A lid 3 was fitted to flask 1 and condenser 4 and thermometer 5 were then fitted into lid 3.
(e) The solution was heated to boiling and boiled for 1 hour, or until brown fume was no longer emitted from the top of the condenser 4.
(f) The solution (and liquor) was then allowed to cool and settle.
(g) The acid liquor was then transferred via viton or tygon tubing 6, and peristaltic pump 7 through a Buchner funnel 8 and into a five liter filter flask 9. The same piece of filter paper is used (not illustrated) for all syphonings and washings. The purpose of the filter paper is to collect fine gold sediment. To aid the filtering process a water jet vacuum pump 10 is also utilised. This pump outlets water into a drain 11.
(h) The filtered acid liquor was placed straight into a 20 liter plastic container for subsequent silver recovery.
(i) The metal in the reaction vessel was given two (2) nitric acid washes to remove any remaining silver. To allow the acid to contact all of the undissolved silver, the pieces are broken up by removing them from the flask and lightly grinding them in the mortar and pestle. Care is needed not to grind the metal too fine as this causes problems in handling the gold later on.

Wash No. 1

(a) After grinding, the gold is washed back into the reaction flask using water.
(b) One (1) liter of water is added.
(c) One (1) liter concentrated nitric acid is slowly added.
(d) The lid and condenser are replaced and the solution is heated to boiling, and boiled for 30 minutes.
(e) The solution is allowed to cool and settle.
(f) The nitric acid is pumped out through the Buchner funnel, being careful not to suck out any of the metal.

Wash No. 2

(a) One (1) liter of water is added.
(b) One (1) liter concentrated nitric acid is added slowly.
(c) The lid and condenser one replaced and the solution is heated to boiling, boiled for 30 minutes.
(d) The solution is allowed cool and settle.
(e) The nitric acid is pumped out as before, again being careful not to suck out any of the metal.
(f) The nitric acid for wash 1 and 2 was combined for use in the next dissolution.
(g) Two (2) liters of water were added, heated to boiling, and boiled for 30 minutes.

(h) The water was pumped out through the Buchner funnel. This water could be re-used in the primary dissolution stage.

Hydrochloric Acid Wash (a) 1.5 liters of 1:1 hydrochloric acid were added, heated to boiling, and held for 30 minutes.
(b) This was allowed to cool and settle.
(c) The hydrochloric acid was pumped out through the Buchner funnel. This acid could be re-used up to three times.

Final Wash (a) Four (4) liters of water were placed into the flask, heated to boiling, and held for 30 minutes.
(b) The water was pumped out, and the gold washed out into the Buchner funnel using the same filter paper as on all previous washings.
(c) Whilst in funnel the gold was washed with a further 2 liters of hot water.
(d) The gold was dried, and collected on the filter paper.
(e) The filter paper was then burned and the gold recovered in a muffle furnace.

Additional Treatment for Gold (a) After the gold has been washed and dried it may be further treated to ensure absolutely 99.99% purity.
(b) Dissolve the finely divided material in a mixture of concentrated hydrochloric/nitric solution and allow any precipitate to settle.
(c) Decant the solution. Separate the precipitate, if any by filtering.
(d) Dilute solution with hot deionised water and bubble sulphur dioxide through it. Gold precipitate will form.
(e) Wash gold precipitate.
(f) Dry and melt in a clean crucible.

Silver Precipitation (A) Recommended Method (a) The 4 liters of acid liquor in the 20 liter container is neutralised by adding sodium hydroxide solution (200 g/liter). Approximately 10 to 11 liters of sodium hydroxide solution is needed to reach a pH of 1.5 to 2 (test using pH papers). Allow the solution to cool, check the pH again and adjust as necessary. If a pH value greater than 2 is obtained, it can be lowered by adding 1:1 nitric acid.
(b) To this solution add 2.4 kg of copper wire (coiled 250 mm lengths). The copper wire should be no thinner than 1 mm, as fine wire breaks up and becomes difficult to separate from the silver precipitate.
(c) With the stirrer, agitate the mixture slowly for 6 hours.
(d) After 6 hours check the pH of the solution. If greater than 2, lower with the addition of 1:1 nitric acid to pH 2 and stir for another hour.
(e) If all the copper has dissolved, check the pH as it could be too low. If low, add more sodium hydroxide solution to pH 2, then add more copper wire.
(f) After 6 hours stirring all the silver should be precipitated as a coarse powder, and the solution can be filtered through the Buchner funnel and flask. Retain the filtrate for recovery of palladium. Separate the residual copper wire from the silver and retain for use in subsequent batches, or use it for inquarting scrap gold.
(g) The silver can be washed with 2 liters of hot water, while in the Buchner funnel.
(h) Dry the silver and metal under borax.

Silver Precipitation (B) Alternative Method

The 4 liters of acid liquor in the 20 liter container is treated as follows to produce a precipitate of silver salt. A rough estimate is made of the silver content of the metal used in the initial dissolution. Calculate the weight in grams of silver present in the metal that has been treated.

For each gram of silver present in the treated metal, 2 grams of sodium chloride is needed. Dissolve the required weight of sodium chloride in 9 times its own weight of water to produce a 10% solution.

Place the 4 liters of acid liquor into a suitable sized container and stir vigorously whiile adding the 10% sodium chloride solution. A white precipitate will form; this is silver chloride. The silver chloride should be collected be filtration using the Buchner funnel. A check can be made on the filtrate to ensure all silver has been precipitated by pouring some more of the 10% sodium chloride solution into the filtrate. If no precipitate forms all the silver has been extracted from the solution. If a precipitate does form, further sodium chloride is needed.

The silver chloride can be converted to silver metal by the following method.

The silver chloride, as collected on the filter paper, is washed with boiling distilled water until the water coming through the funnel is not acid, but near neutral. This can be checked with pH papers so as to get a reading above pH 5. The silver chloride should then be dried in a drying oven at 100° C.

The dry silver chloride is then placed into a small graphite crucible. A typical charge is:

500 g silver chloride
50 g borax
20 g silica

The temperature is slowly taken up to 1100° C. At this temperature the flux floats to the surface, inhibiting the volatilisation of the silver chloride. A total amount of 60 g of sodium carbonate is sprinkled over the charge, 20 g at a time, the reaction being allowed to subside between additions.

The silver metal formed sinks to the bottom of the crucible. The crucible is removed from the oven and allowed to stand until the metallic silver button has solidified. The chloride and flux mixture is poured off into a shallow steel mould. The silver is recovered from the bottom of the crucible. The flux coating on the silver button can be removed by placing the solid button into water while it is still warm.

Some silver chloride is retained in the borax flux and can be recovered by re-using the flux in subsequent batches.

Palladium Recovery

If the alloy contained palladium, it can be recovered from the solution remaining after the silver has been recovered.

(a) A 1% solution of dimethylglyoxime (DMG) is prepared by dissolving 1 g DMG per 100 ml of (95%) ethanol.
(b) Make an estimate of the amount of palladium contained in the initial alloy. For each gram of palladium contained, add 300 ml of DMG solution to the solution.

(c) After the correct amount of DMG has been added, the solution is stirred and heated to 50° C., then allowed to stand.

(d) A palladium-DMG complex will form as the solution cools. This can be then filtered and washed with hot distilled water in the Buchner funnel.

(e) A check to ensure all the palladium has been precipitated is to add extra DMG solution to the filtrate after filtering, if a precipitate forms repeat above process until the addition of excess DMG solution produces no further precipitate.

(f) The palladium complex can be then converted to palladium metal by first drying at 100° C. and then slowly heating to 800° C.

Platinum Recovery

If the alloy contained platinum, it can be recovered from the filtrate remaining after the palladium has been recovered.

(a) A 20% ammonium chloride solution is prepared by dissolving 20 g of ammonium chloride per 100 ml of distilled water.

(b) Make an estimate of the amount of platinum contained in the initial alloy. For each gram of platinum contained, add 50 ml of 20% ammonium chloride solution.

(c) After adding the ammonium chloride, the solution is stirred and allowed to stand for 1 hour.

(d) If no precipitate forms the solution can be acidified to aid the precipitation. This is done by slowly adding, whilst stirring, concentrated hydrochloric acid. This can be added up to 25% of the initial volume.

(e) The precipitate which forms is ammonium hexachloroplatinate. This can be filtered in the Buchner funnel. It is water-soluble and must be washed with 20% ammonium chloride solution, not distilled water.

(f) If further precipitate forms in the filtrate with the addition of excess ammonium chloride solution, the recovery process is repeated until no further precipitation is produced.

(g) The platinum salt can then be converted to platinum metal by first drying at 100° and then slowly heating to 800° C.

Another method for nitric acid parting is as follows: This method is for utilisation with 500–1000 g of gold, silver, copper alloy containing not more than 25% gold. This alloy is preferably homogenous and granulated as fine as practicable to assist dissolution. Reagents used in this method should preferably be laboratory reagent quality equivalent to Ajax Chemicals UNILAB TM grade. Before performing this method at least 15 liters of deionized water should be placed in the aspirator. This water is also to be chloride free, i.e. no white precipitate with silver nitrate.

Primary parting (1) Put 500 to 1000 grams of 25% alloy into the parting flask. Fit the lid and fix condenser, thermometer, and dropping funnel. Put a stopper in the remaining hole.

(2) Set the fume scrubber going.

(3) Primary parting acid: Have available 4 liters of nitric wash acid from the previous run. If not, make up, in a separate beaker, 4 liters of dilute acid from 2 liters of concentrated acid and 2 liters of deionised water. (When making up acids, always add acid to water.)

(4) Add about 500 ml of parting acid to the dropping funnel. Open the cock on the funnel slowly and allow the parting acid to drip into the metal. Control the rate of addition of acid so that the reaction is not excessively violent and so that the rate of production of brown fumes is not more than can be handled by the scrubber. Add more parting acid to the dropping funnel and to the parting flask until the quantity in the flask is 4 liters.

(5) When the reaction is suitably quiet, turn on the heat slowly (bottom element only) and raise the temperature to boiling. Boil for 1 hour or until brown fumes are no longer emitted from the top of the condenser.

(6) Allow to cool and dismantle. Turn off the fume scrubber. Cooling can be assisted by adding cold, deionised water until the flask is full. Allow to settle.

(7) When the temperature of the acid in the parting flask is less than 50° C., set up the 5 liter filter flask and funnel. Wet the filter paper with water and turn on the vacuum. Set up the peristaltic pump.

(8) Pump the acid from the parting flask onto the filter paper. Avoid picking up the settled solids (i.e. the gold residue) in the parting flask.

(9) When all the parting acid has been removed, transfer the gold residue to a 500 ml beaker and grind it in three or four lots in the glass mortar and pestle. Avoid too much grinding as it makes the precipitate difficult to settle later.

(10) Wash the filter paper several times with hot deionised water. Dry the paper and eventually burn for recovery of gold.

First Nitric Acid Wash (1) Return the ground gold residue to the parting flask and add 1 liter of deionised water. Place the lid, condenser and dropping funnel on the flask. Start the fume scrubber.

(2) Slowly add through the dropping funnel, 1 liter of concentrated nitric acid. Heat to boiling and boil for 30 minutes.

(3) Cool and settle. Dismantle.

(4) Decant the cooled wash acid into a beaker and save this for the next parting. Leave the gold residue in the flask.

Second Nitric Acid Wash (1) Add 1 liter of deionised water to the parting flask, add 1 liter of concentrated nitric acid (no need to use the dropping funnel this time); fit lid and condenser only.

(2) Heat to boiling and boil for 30 minutes.

(3) Cool and settle, dismantle.

(4) Decant the cooled wash acid into a beaker and save for the next parting. Leave the gold residue in the flask.

First Water Wash (1) Break up any aggregates with a stirring rod and add 1 liter of deionised water to the parting flask, fit lid and condenser, heat to boiling for 30 minutes. Dismantle, add about 1 liter of cold deionised water for cooling, stir well.

(2) Cool and settle and decant wash water. Hold the decanted water for long-time settling before wasting. Leave the gold residue in the flask.

Second Water Wash (1) Break up any aggregates with a stirring rod and add 1 liter of deionised water to the parting flask, fit lid and condenser, and heat to boiling for 30 minutes. Dismantle, add about 1 liter of cold deionised water for cooling, stir well.
(2) Cool, settle and decant the wash water. Hold the decanted water for long-time settling before wasting. Leave the gold residue in the flask.

Hydrochloric Acid Wash (1) Break up any aggregates with a stirring rod and add 750 ml water to the parting flask and then 750 ml of concentrate hydrochloric acid. Fit the lid and condenser and boil for 30 minutes.
(2) Cool and settle.
(3) Decant the hydrochloric wash acid into a 5-liter beaker and save for the recovery of soluble gold.
(4) Break up any aggregates with a stirring rod and add 1.5 liters of water to the parting flask, boil for 30 minutes. Cool, settle and decant the wash liquor into the same 5-liter beaker as step (3).
(5) Break up any aggregates with a stirring rod and add another issue of 1.5 liters of water to the parting flask, boil again for 30 minutes. Cool, settle and decant the wash liquor into the 5-liter beaker.
(6) Transfer the residual gold to the same filter paper and wash with about 2 liters of hot water on the filter paper. Save the filtrate for recovery of soluble gold.
(7) Transfer the precipitate and filter paper to a stainless steel tray and dry the precipitate.

Recovery of Soluble Gold from the Hydrochloric Wash Liquor (1) Combine all the hydrochloric washings into a 5-liter beaker.
(2) Add about 10 grams of zinc metal. When the reaction is complete, sample the liquor. Add about 1 gram of zinc to the sample and note whether another precipitate forms. If it does, add another 10 grams of zinc metal to the washing and test again. Continue in this way until all the gold is precipitated.
(3) Allow to settle overnight or longer and then decant. Transfer the precipitate to a 500 ml beaker, add say 300 ml hot deionised water, stir well and filter.
(4) Wash the precipitate of the filter several times with hot water then dry the precipitate.
(5) Retain the decant liquor and the filtrate for long-time settling.
(6) Accumulate the hydrochloric decant liquors in a 100 liter drum and, at some suitable time when there is 50 liters or more accumulate, mix the liquors and assay for gold. If the assay is suitably low, say less than 0.05 g/l, waste the solution. If the assay is greater than this value, add more zinc and precipitate the remaining gold. Note that the waste solution is acid and must be neutralised with soda ash before disposing to the sewer.

Silver Recovery from Primary Parting Filtrate (1) Make up a 10% (sodium chloride) solution by dissolving 100 grams of salt in 1 liter of water.
(2) Dilute the primary parting filtrate to about 10 liters—use tap water.
(3) Add 200 ml of salt solution to the primary parting filtrate. Stir well and allow to settle. Take a sample of the settled liquor into a 500 ml beaker, add about 5 ml of salt solution to the beaker and see whether a white precipitate forms. If it does, add another 200 ml of salt solution to the primary parting filtrate and test again. Continue in this manner until all the chloride silver is precipitated.
(4) Allow the silver chloride precipitate to settle say for 1 day, or longer if convenient, and then decant the liquor into another bucket. Add soda ash to the decant liquor, slowly. Copper carbonate will precipitate and when the liquor is no longer acid, it will stop fizzing. Check with the pH papers that the liquor is pH 7 or greater (if not, add more soda ash) and allow it to settle say 24 hours or longer. At this stage the liquor may be safely disposed down the drain and the settled copper carbonate can be taken to the tip.
(5) Transfer the silver chloride precipitate to a 500 ml beaker and filter. Wash several times on the filter with hot water, then dry the precipitate and weight it.
(6) Smelt the silver chloride precipitate to metal as follows: Make a charge for a small graphite crucible:
500 g silver chloride
50 g borax
20 g silica The temperatures is slowly taken up to 1100° C. At this temperature the flux floats to the surface, inhibiting the volatilisation of the silver chloride. At total amount of 60 g of sodium carbonate is sprinked over the charge, 20 g at a time, the reaction being allowed to subside between additions.

The silver metal formed sinks to the bottom of the crucible. The crucible is removed from the oven and allowed to stand until the metallic silver button has solidified. The chloride and flux mixture is poured off into a shallow steel mould. The silver is recovered from the bottom of the crucible. The flux coating on the silver button can be removed by placing the solid button into water while it is still warm. The flux will crack and then can be easily removed.

Some silver chloride is retained in the borax flux and can be recovered by re-using the flux in subsequent batches.

Long-time Settling of Nitric Acid Washings (1) The nitric acid washings contain fine suspended gold which requires long-time settling for recovery. Accumulate the washings in a 100 liter drum. This should be enough for about 25 batches.
(2) Leave the drum to stand for about a week after the last addition of wash liquor. Tap the side of the drum occasionally during this week so that any material which settles on the side is dislodged and eventually settles.
(3) Carefully pump out the supernatant liquor into another drum, being careful to leave the gold precipitate behind. Now rinse the settled precipitate into a beaker, filter and wash with hot water. Dry the filter paper and precipitate and burn for the recovery of gold.
(4) Neutralise the decant liquor to pH 7 to 9 using soda ash and then waste.

Nitric Oxide Fume Scrubber (1) Make-up: Fill the drum, say three-quarters full, with tap water. Pre-dissolve about 5 kg of soda ash (sodium carbonate) in water and add it to the water in the drum.
(2) Running: the pH of the liquor in the drum must be 10 or greater. Check this once a day and if necessary add 1 kg of either soda ash or caustic soda, pre-dissolved in tap water. After say one month of operation, waste contents of the drum and make up a new batch.

The effectiveness of the scrubber can be judged by watching the froth on the surface of the drum. A properly operating scrubber will have a fairly white froth. If the froth tends to be yellow, or if some brown fumes can be detected just above the froth, add 1 kg of either soda ash or caustic soda, pre-dissolved in tap water.

A schematic layout of the refining process is shown in FIG. 2 in respect of refining of gold from its ore. The ore is prepared at 12 and then fed to a crushing stage 13 where it is crushed to a suitable particle size. The ore is then heated in a furnace 14 with a base metal such as copper to inquart the gold to a concentration of approximately 25%. The thus formed "alloy" is then poured, in the molten state, into water in the quenching stage 15 where open faced granules, having large surface area per granular volume, are formed.

These granules are then treated in the primary parting 16 with nitric acid to dissolve the base metals leaving a solid residue of substantially pure gold. The parting is carried out along similar lines as that of the before described methods. The granules are then washed at 18. The dissolved silver is recovered in a further silver recovery stage 17 using any suitable method.

The gold granules are then treated in a secondary parting stage 19 with nitric acid and passes through a further wash stage 20 where the granules are treated in a final nitric acid parting 21, to remove as much undissolved silver as possible. The thus treated granules then undergo a further wash 22, and pass through a hyrochloric acid wash 23, after which the granules are washed 24 and filtered 25.

The thus refined gold is crushed 26, then dried 27, assayed 28, melted 29 and casted 30, and stamped 31 to produce the final product 32.

The foregoing describes two embodiments of the present invention, and modifications made by those skilled in the art can be made thereto without departing from the scope of the present invention.

I claim:

1. A method of refining gold comprising the steps of:

(a) assaying the material, containing the gold to be extracted, to determine the concentration of the gold in the material;

(b) inquartating the material containing the gold to be extracted into an alloy with a known quantity of a base metal to form an alloy having between 15% and 40% gold;

(c) pouring the metal alloy into water in order to form porous open-faced granules;

(d) dissolving the base metal in nitric acid to leave the refined gold; and (e) filtering the gold from the thus formed solution.

2. A method of refining gold as claimed in claim 1 wherein the alloy has a gold concentration of approximately 25%.

3. A method of refining gold according to claim 1 including the additional step of using a hydrochloric acid parting after the nitric acid parting.

4. A method of refining gold according to claim 2 including the additional step of using a hydrochloric acid parting after the nitric acid parting.

* * * * *